US007641302B2

(12) United States Patent
Lee

(10) Patent No.: US 7,641,302 B2
(45) Date of Patent: Jan. 5, 2010

(54) APPARATUS AND METHOD OF COMPENSATING FOR DEFECTIVE NOZZLE

(75) Inventor: Ho-keun Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 313 days.

(21) Appl. No.: 11/420,120

(22) Filed: May 24, 2006

(65) Prior Publication Data

US 2007/0019012 A1 Jan. 25, 2007

(30) Foreign Application Priority Data

Jul. 22, 2005 (KR) ..... 10-2005-0066966

(51) Int. Cl.
*B41J 29/393* (2006.01)

(52) U.S. Cl. ..... 347/19; 347/13; 347/42

(58) Field of Classification Search ..... 347/5, 347/9, 12–13, 19, 42, 43, 15
See application file for complete search history.

(56) References Cited

U.S. PATENT DOCUMENTS 6,089,693 A * 7/2000 Drake et al. ..... 347/19
7,278,699 B2 * 10/2007 Drake et al. ..... 347/13

FOREIGN PATENT DOCUMENTS

| | | |
|---|---|---|
| JP | 6-226982 | 8/1994 |
| JP | 11-245396 | 9/1999 |
| JP | 2002-11857 | 1/2002 |
| JP | 2004-58284 | 2/2004 |
| KR | 1993-11660 | 12/1993 |
| KR | 1999-58137 | 7/1999 |

OTHER PUBLICATIONS

Korean Office Action dated Sep. 6, 2006 issued in KR 2005-66966.

* cited by examiner

*Primary Examiner*—Lam S Nguyen
(74) *Attorney, Agent, or Firm*—Stanzione & Kim LLP

(57) ABSTRACT

An apparatus and method of compensating for defective nozzles. Accordingly, in an image forming apparatus having inkjet nozzles (i.e., an inkjet printer), image quality deterioration due to defective nozzles (i.e., nozzles that cannot discharge ink) may be compensated for by replacing data after moving a printer head to an optimum position. Image quality deterioration due to defective nozzles may also be compensated by replacing data to be printed after moving at he printer head to the optimum position.

16 Claims, 8 Drawing Sheets

APPARATUS AND METHOD OF COMPENSATING FOR DEFECTIVE NOZZLE

CROSS-REFERENCE TO RELATED APPLICATIONS

This application claims the priority of Korean Patent Application No. 10-2005-0066966, filed on Jul. 22, 2005, in the Korean Intellectual Property Office, the disclosure of which is incorporated herein in its entirety by reference.

BACKGROUND OF THE INVENTION

1. Field of the Invention

The present general inventive concept relates to an apparatus and method of compensating for defective nozzles, and more particularly, to an apparatus and method of compensating for image quality deterioration due to defective inkjet nozzles (i.e., nozzles that cannot discharge ink) of an image forming apparatus, such as an inkjet printer, by replacing data after moving a printer head to an optimum transfer position.

2. Description of the Related Art

An image forming apparatus such as an inkjet printer includes a plurality of inkjet nozzles. When some of the inkjet nozzles are defective, image quality may deteriorate. Examples of the defective nozzles include a nozzle that does not discharge ink and a nozzle that discharges an excessive amount of ink.

In order to compensate for image quality deterioration caused by defective nozzles, various methods have been proposed, such as a method of rearranging half-toned data and a method in which a dot to be formed by a defective nozzle is formed by a normal nozzle, after a printer head moves horizontally and places the normal nozzle in a position of the corresponding defective nozzle.

However, the hardware for implementing the former method in the case of a defective nozzle is very complicated due to a complex algorithm for rearranging the data, and a printed image may become distorted due to a rearrangement of a large amount of half-tone data. In particular, when a text portion or a graph portion which must not be rearranged is moved to another dot position by data rearrangement, the distortion of the printed image becomes very severe.

In addition, in the latter method, in which the printer head has to move many times to compensate for all the defective nozzles, a printing operation is performed several times per each line to be printed, which leads to a slow printing speed.

SUMMARY OF THE INVENTION

The present general inventive concept provides an apparatus and method of compensating for image quality deterioration due to defective inkjet nozzles (i.e., nozzles that cannot discharge ink) of an image forming apparatus, such as an inkjet printer, to replace data after a printer head moves to an optimum transfer position.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept are achieved by providing an apparatus to compensate for one or more defective nozzles in a printer head having a plurality of nozzles disposed parallel to a direction perpendicular to a paper transfer direction, including a defective nozzle position detection unit to detect a position of the defective nozzle among the nozzles of the printer head; a data storage unit to store data respectively to correspond to the plurality of nozzles indicating whether the nozzles discharge ink; a correlation estimation unit which estimates a correlation between the position of the defective nozzle and data corresponding to the defective nozzle among the stored data at each position to which the printer head moves in a direction perpendicular to the paper transfer direction, and outputs information of a transfer position having the greatest correlation among the estimated correlations; and a print unit to place the printer head at the transfer position having the greatest correlation based on transfer position information provided by the correlation estimation unit and then to perform a print operation.

In the aforementioned aspect of the general inventive concept, the correlation estimation unit may estimate the correlation by counting the number of data corresponding to the defective nozzle indicating the defective nozzle does not discharge ink.

In addition, the general inventive concept may further include a data replacement unit to replace data corresponding to the defective nozzle indicating the defective nozzle discharges ink with adjacent data at the transfer position having the greatest correlation.

In addition, the data replacement unit may not carry out the data replacement for data indicating the defective nozzle discharges ink among the data that is set not to be replaced.

The foregoing and/or other aspects and utilities of the present general inventive concept may also be achieved by providing a method of compensating for one or more defective nozzles in a printer head having a plurality of nozzles which is disposed parallel to a direction perpendicular to a paper transfer direction, including detecting a position of the defective nozzle among the nozzles of the printer head, storing data respectively corresponding to the plurality of nozzles indicating whether the nozzles discharge ink, estimating a correlation between the position of the defective nozzle and data corresponding to the defective nozzle among the stored data at each position where the printer head moves in a direction perpendicular to the paper transfer direction, placing the printer head at the transfer position having the greatest correlation, and performing a print operation.

The correlation may be estimated by counting the number of data indicating the defective nozzle does not discharge ink among data that corresponds to the defective nozzle.

In addition, the method may further comprise replacing data indicating the defective nozzle discharges ink with adjacent data.

In addition, in the replacing operation, the data replacement is not performed on the data indicating the defective nozzle discharges ink among data that is set not to be replaced.

The foregoing and/or other aspects and utilities of the present general inventive concept may also be achieved by providing a computer-readable medium having embodied thereon a computer program to execute a method of compensating for one or more defective nozzles in a printer head having a plurality of nozzles which is disposed parallel to a direction perpendicular to a paper transfer direction, including detecting a position of the defective nozzle among the nozzles of the printer head, storing data respectively corresponding to the plurality of nozzles indicating whether the nozzles discharge ink, estimating a correlation between the position of the defective nozzle and data corresponding to the defective nozzle among the stored data at each position where the printer head moves in a direction perpendicular to the paper transfer direction, and performing printing after placing the printer head at the transfer position having the greatest correlation.

The foregoing and/or other aspects and utilities of the present general inventive concept may also be achieved by providing an apparatus to compensate for defective nozzles of a print unit, including a defective nozzle detection unit to detect defective nozzles of a print head of a print unit, a correlation estimation unit to estimate a correlation between data representing the detected defective nozzles and the data representing the greatest number of data units not to be printed among the data to be printed.

The foregoing and/or other aspects and utilities of the present general inventive concept may also be achieved by providing a method of compensating for a defective nozzle including determining a position of a defective nozzle on a printer head having a plurality of nozzles, determining whether each of the plurality of nozzles corresponds to an image data of an image to be printed, determining whether the position of the defective nozzle corresponds to a nozzle to print image data to be printed, estimating a transfer position of the plurality of nozzles to correlate the image data to be printed with the least amount of defective nozzles, and moving the printer head to the transfer position estimated to have the least amount of defective nozzles for the image data to be printing.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
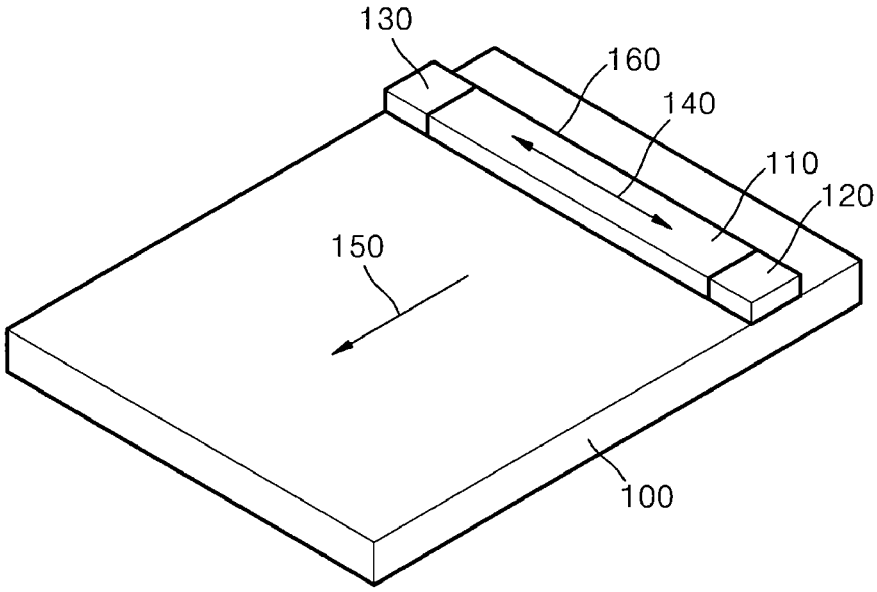
FIG. 1 (PRIOR ART)
FIG. 1 is a perspective view illustrating a portion of a conventional image forming apparatus having a general array type printer head.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a perspective view illustrating a portion of a conventional image forming apparatus having a general array type printer head, which includes a main frame 100, an array type printer head 110, and printer head control units 120 and 130.

The array type printer head 110 is disposed on the main frame 100 and can move in a perpendicular direction 140 with respect to a paper transfer direction 150. Further, the array type printer head 110 includes a plurality of inkjet nozzles 160 disposed parallel to the perpendicular direction 140. The plurality of inkjet nozzles discharge inks according to a control of the printer head control units 120 and 130. Whether ink is discharged through each inkjet nozzle is determined based on an image data to be printed. In general, the image data to be printed, that is, half-tone data, corresponds one-to-one to each nozzle. When the half-tone data demands ink discharge, ink is discharged through nozzles corresponding to the half-tone data.

Figure 2:
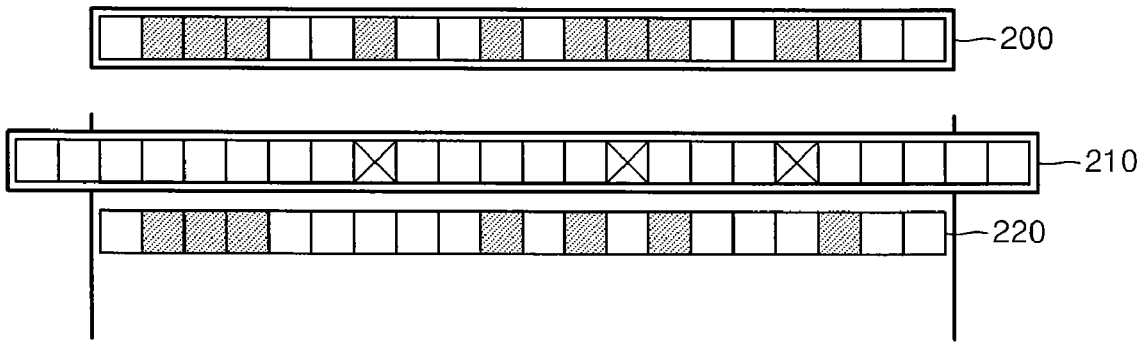
FIG. 2 (PRIOR ART)
FIG. 2 is a view illustrating a conventional array type printer head having defective nozzles and a printing result obtained using the same.

FIG. 2 is a view illustrating an array type printer head having defective nozzles and a printing result obtained using the same.

Data 200 to be printed corresponds one-to-one to a nozzle among a plurality of nozzles of a printer head 210. Each square portion of the print head 210 indicates an individual nozzle. The gray portions of the data 200 depicts a portion of a desired image to be printed by the corresponding nozzle that requires an ink discharge therefrom to create a printing result 220. If defective nozzles exist in the print head 210, the desired image cannot be obtained since the ink is not discharged therethrough. Portions indicated by X in the printer head 210 denote positions of defective nozzles that do not discharge ink. In particular, when data corresponding to a portion of the desired image to be printed is sent to the defective nozzle, which does not discharge ink, yet indicates that the nozzle has discharged ink, print quality deteriorates.

Figure 3:
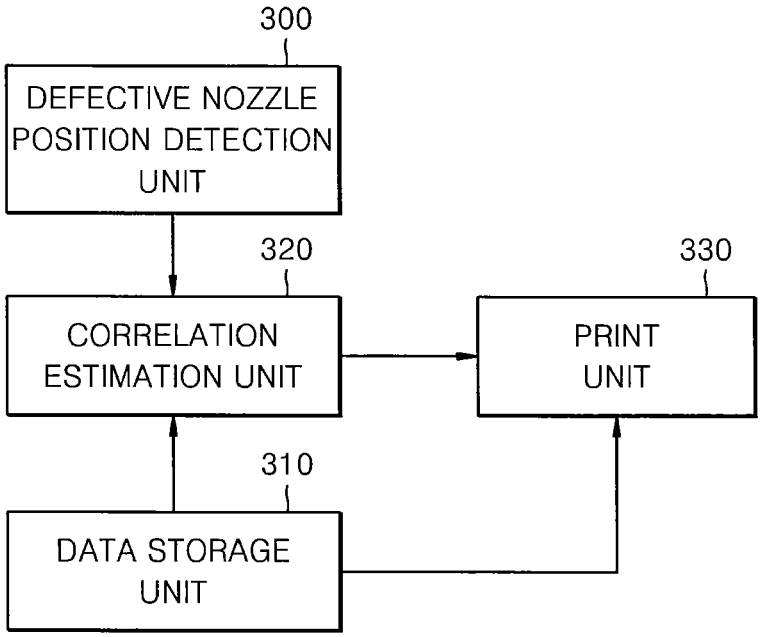
FIG. 3 is a block diagram illustrating a structure of an apparatus to compensate for defective nozzles according to an embodiment of the present general inventive concept.

FIG. 3 is a block diagram illustrating a structure of an apparatus to compensate for defective nozzles according to an embodiment of the present general inventive concept. The apparatus of FIG. 3 includes a defective nozzle position detection unit 300, a data storage unit 310, a correlation estimation unit 320, and a print unit 330.

The defective nozzle position detection unit 300 detects a position of a bad inkjet nozzle among the plurality of inkjet nozzles. Examples of bad inkjet nozzles may include a nozzle that discharges a larger or smaller amount of ink than a predetermined amount of ink or a nozzle that does not discharge ink at all. The predetermined amount of ink denotes the amount of ink corresponding to data input to the inkjet nozzle. The input data may be half-tone data that generally has a binary value, i.e., 0 or 1. Thus, based on the binary value of the input data to the inkjet nozzle, the predetermined amount of ink may or may not be discharged.

Various embodiments of methods of recognizing the position of a defective inkjet nozzle include a method in which a module included in the printer head detects whether the inkjet nozzle operates properly and a method that includes an additional apparatus to detect the position of the defective inkjet nozzle by using a print test.

The data storage unit 310 stores data respectively corresponding to the plurality of inkjet nozzles indicating whether the nozzles discharge ink. The data indicating whether the inkjet nozzles discharge ink is usually called half-tone data.

The correlation estimation unit 320 estimates a correlation between a position of the defective nozzle and the stored data corresponding to the defective nozzle at each position where the printer head moves in a direction perpendicular to the paper transfer direction, and outputs information of a transfer position having the greatest correlation among the estimated correlations. Specifically, the correlation may be estimated by counting the number of data indicating that the defective nozzle discharges ink at each transfer position. Although the printer head may actually move, the correlation may be estimated using a hypothetical movement. The hypothetical movement of the printer head may be represented in various ways, such as a dot unit or integral multiples of dots, and a maximum movement may vary based on a hardware condition of the printer head.

Based on transfer position information provided by the correlation estimation unit 320, the print unit 330 places the printer head at the transfer position having the greatest correlation to obtain data from the data storage unit 310, and then carries out a printing operation. Meanwhile, even when the printer head is placed at the transfer position having the greatest correlation, uncompensated defective nozzles may exist. To prevent this, a replacement unit, which will be described later, may be provided for further compensation.

Figure 4A:
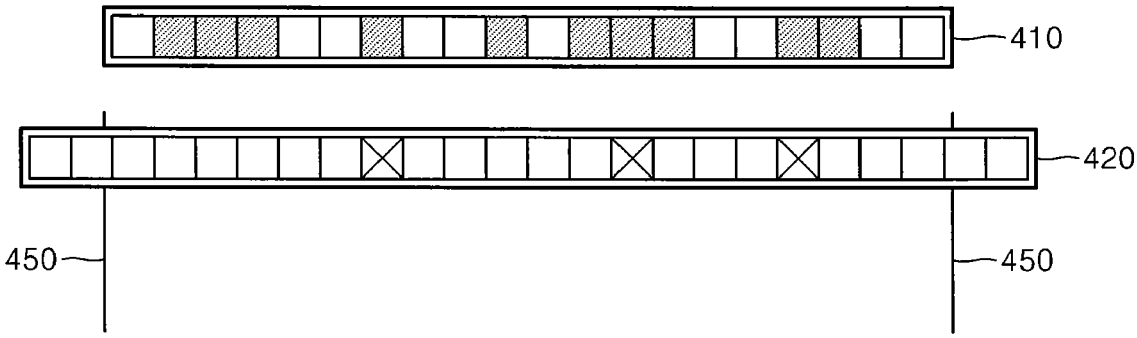
FIGS. 4A through 4C are views illustrating a correlation estimation process, according to an embodiment of the present general inventive concept.
Figure 4B:
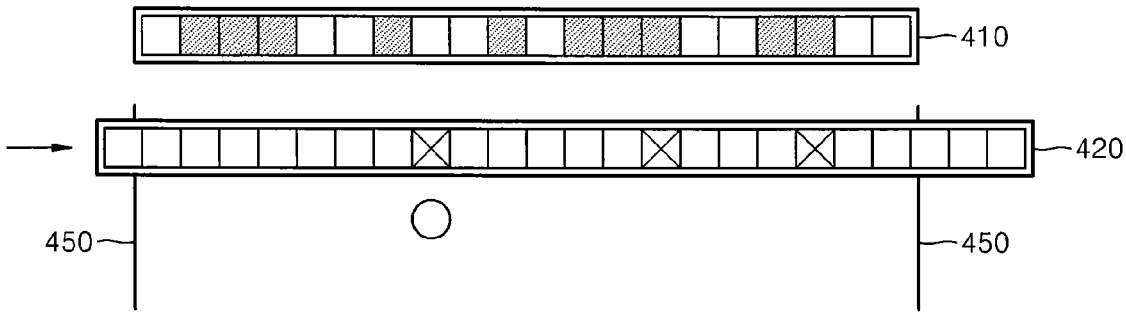
Figure 4C:
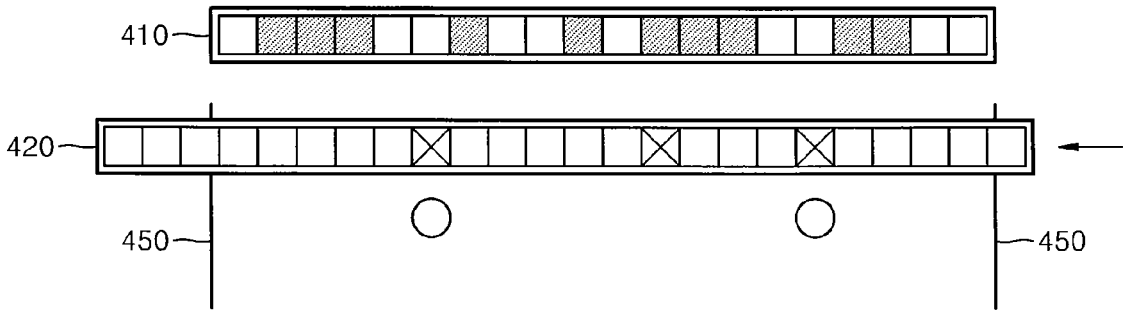

FIGS. 4A to 4C are views illustrating a correlation estimation process at the transfer position of FIG. 2, according to an embodiment of the present general inventive concept.

FIG. 4A is a view illustrating the correlation estimation process performed in the condition that the printer head is at the same position as in FIG. 2. Data 410 has a number of data units that correspond to a number of nozzles of the printer head 420 (represented as individual squares therein) to discharge ink. The inkjet nozzles that correspond to the data 410 fall within corresponding lines 450. The data 410 may either be data to discharge ink, represented as gray squares, and data to not discharge ink, represented as white squares. Nozzles of the printer head 420 that fall outside the corresponding lines 450 do not receive the data 410. In this example, the data 410 indicates ten locations to discharge ink. Further, three out of the ten data locations to discharge ink illustrate defective inkjet nozzles, each of which are indicated by X. In this example, the correlation is 0. The correlation may be estimated in various ways, and in the present embodiment, the correlation is estimated by counting the number of data indicating the defective nozzles discharge ink. For each print cycle of the printer head 420, the transfer position of the printer head 420 is estimated and then the printer head 420 is positioned at the transfer position that has a minimal number of detected defective inkjet nozzles. The higher the correlation value for a transfer position, the lower the number of defective inkjet nozzles detected to discharge ink.

FIG. 4B is a view illustrating the correlation estimation process when the printer head 420 moves by one dot to the right with respect to the data 410, as indicated by the change of position with respect to the corresponding lines 450. Since the number of data indicating the defective nozzle discharging ink is 1, the correlation is 1. The data position is indicated by 0.

FIG. 4C is a view illustrating the correlation estimation process when the printer head 420 moves by one dot to the left. According to the aforementioned way of estimating the correlation, the estimated correlation is 2.

The print unit 330 finally performs printing by moving the printer head to the transfer position having an estimated correlation of 2 illustrated in FIG. 4C. Meanwhile, referring to FIG. 4C, it can be seen that one data is uncompensated. In this case, even when the printer head moves to an optimum position according to the correlation estimation to perform printing, image quality may deteriorate slightly due to the uncompensated data. To solve this problem, the present general inventive concept also provides a process of replacing data to compensate for the image quality deterioration.

Figure 5:
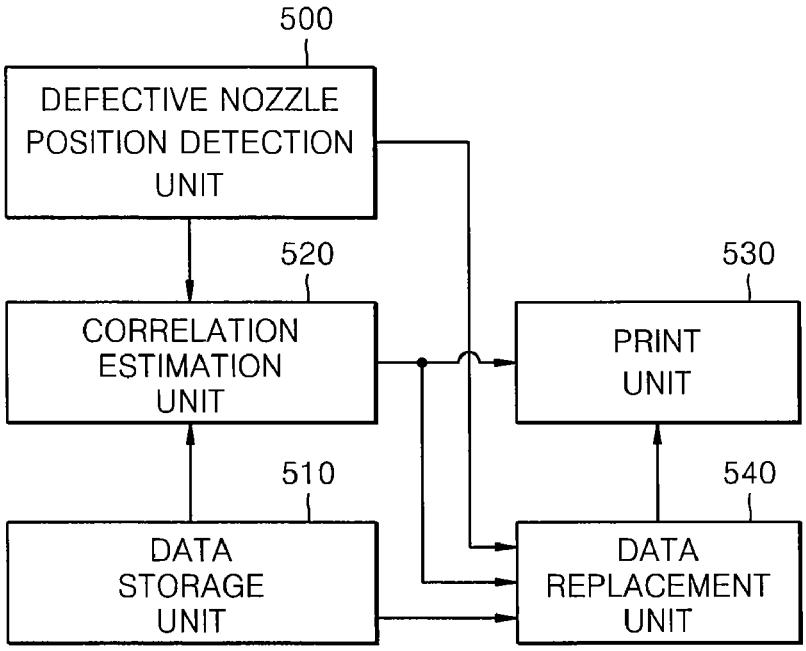
FIG. 5 is a block diagram illustrating a configuration of an apparatus to compensate for defective nozzles according to another embodiment of the present general inventive concept.

FIG. 5 is a block diagram illustrating a configuration of an apparatus to compensate for defective nozzles according to another embodiment of the present general inventive concept. The apparatus of FIG. 5 includes a defective nozzle position detection unit 500, a data storage unit 510, a correlation estimation unit 520, a print unit 530, and a data replacement unit 540.

Since the operations of the defective nozzle position detection unit 500, the data storage unit 510, and the correlation estimation unit 520 are the same as in those of the defective nozzle position detection unit 300, the data storage unit 310, and the correlation estimation unit 320, respectively, of the embodiment if FIG. 3, descriptions thereof will be omitted.

In order to compensate for an uncompensated defective nozzle even when the printer head moves to the optimum transfer position based on the correlation estimation as mentioned above, the data replacement unit 540 replaces data indicating that the defective nozzle discharges ink with adjacent data and provides the data to the print unit 530. The print unit 530 obtains the data from the data replacement unit 540, moves the printer head to the transfer position having the greatest correlation by using transfer position information provided by the correlation estimation unit 520, and then carries out a printing operation.

Figure 6:
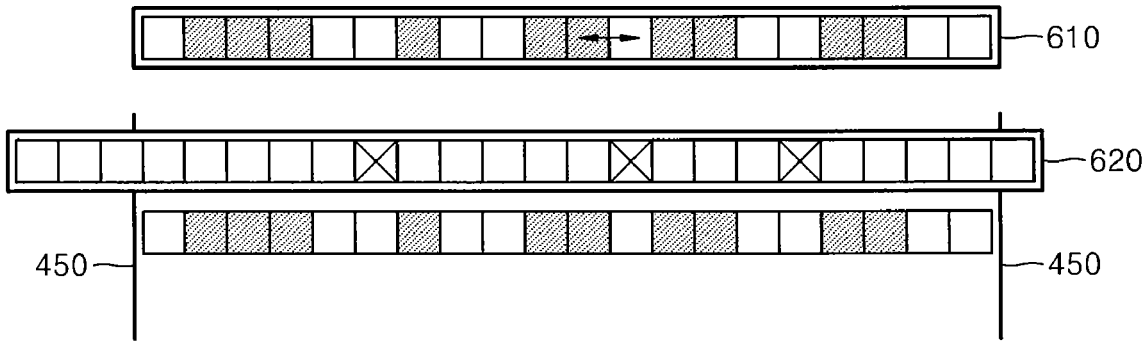
FIG. 6 is a view illustrating an operation of a data replacement unit according to an embodiment of the present general inventive concept.

FIG. 6 is a view illustrating an operation of the data replacement unit 540 according to an embodiment of the present general inventive concept.

Referring to FIG. 6, data 620 indicating that the uncompensated defective nozzle discharges ink is replaced with adjacent data as indicated by an arrow, when the printer head moves to the transfer position having the greatest correlation as shown in FIG. 4C. Namely, the data replacement unit 540 replaces data, which indicates that the defective nozzle discharges ink, with adjacent data at the transfer position having the greatest correlation. The adjacent data, which is positioned to the left or right of the data indicating that the defective nozzle discharges ink, may not indicate whether nozzles discharge ink.

In another embodiment, the data may include a text portion or a graph portion to be printed. If data replacement is carried out for data of the text portion or a graph portion, the resulting image quality may deteriorate. Image quality may deteriorate because some dots of text or a graph can be easily visually recognized by a user when the dots are isolated after the data replacement. On the contrary, some data that does not form an outline cannot be visually recognized even when dot positions are slightly changed. Thus, the data replacement unit 540 may not carry out a data replacement operation for data set not to be replaced, such as text data or graph data.

For the data set not to be replaced, good print image quality can be obtained after the data replacement, when the correlation is estimated by using a negative weight in the correlation estimation process.

Namely, FIG. 5 illustrates that for the data corresponding to the defective nozzle indicating that the defective nozzle discharges ink among data set not to be replaced, the correlation estimation unit 520 may perform a counting operation by using negative weight. Detailed operations for this will be described with reference to FIGS. 7A to 7C.

Figure 7A:
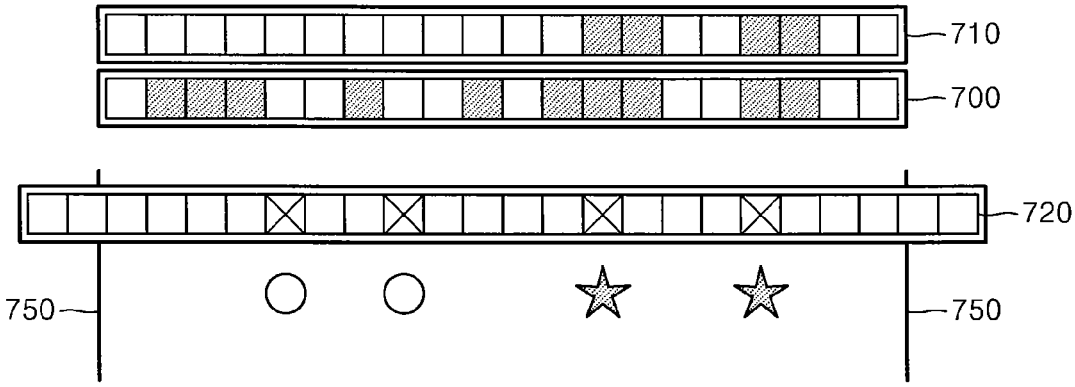
FIGS. 7A through 7C are views illustrating operations of a correlation estimation
Figure 7B:
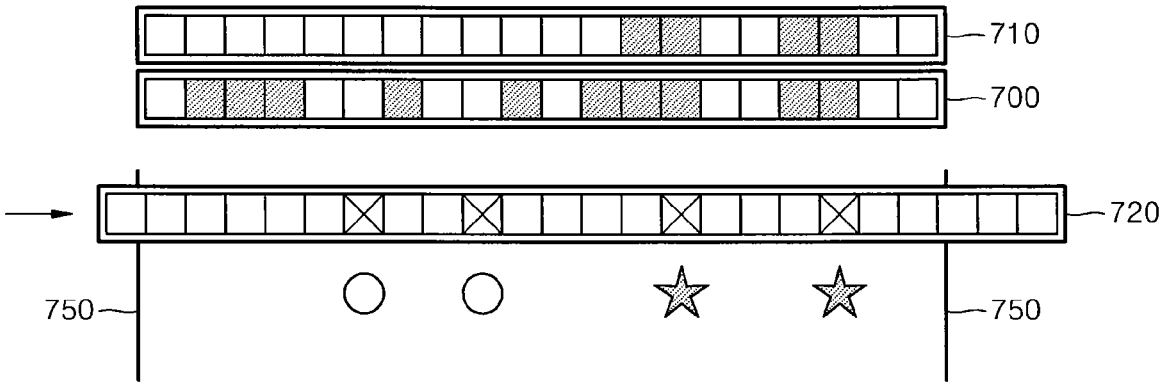
Figure 7C:
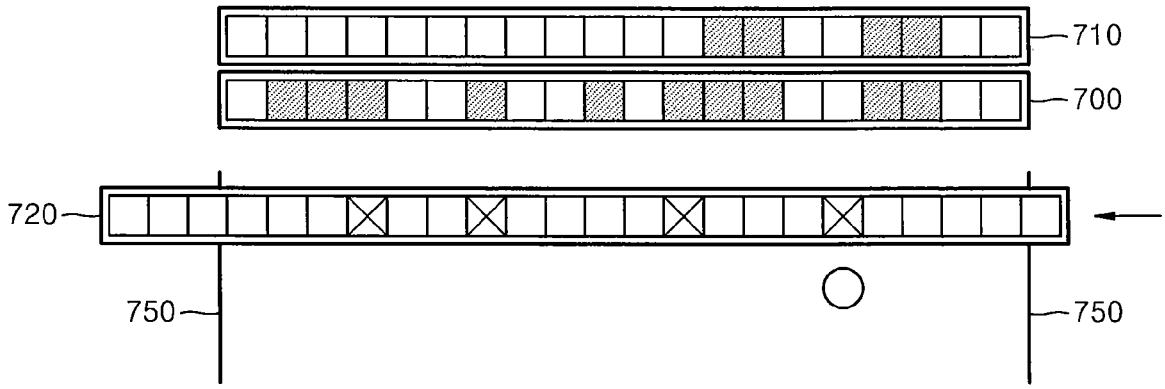

FIGS. 7A through 7C are views illustrating operations of the correlation estimation unit 520 according to another embodiment of the present general inventive concept.

FIG. 7A is a view illustrating an operation of estimating a correlation at an original position where a printer head has not moved. A mask data 710 is used to indicate positions of data for a text portion or a graph portion among data 700 to be printed. Gray portions of the mask data 710 indicate that the corresponding data 700 forms a text portion or a graph portion. Since the data is set not to be replaced, the correlation may be estimated by using a negative weight in the correlation estimation process. In addition, corresponding lines 750 illustrate a correspondence between the inkjet nozzles (each shown as an individual square) of the printer head 720 to the data 700. The negative weight may be set to various values. For convenience, the negative weight is set to −1 in the present embodiment.

In FIG. 7A, the number of data indicating that the defective nozzle is to discharge ink are illustrated by circles. In other words, two defective nozzles are to discharge ink. Data that is set not to be replaced and to be printed by a defective nozzle are illustrated by stars. In other words, two defective nozzles receive data that is set not to be replaced. Since a weight of −1 is set for the data to not be replaced, the final correlation is 1 +1 −1 −1, that is, 0.

FIG. 7B is a view illustrating an operation of estimating a correlation at a transfer position where a printer head moves by one dot to the right. Thus, the printer head 720 moves to the right with respect to the corresponding lines 750. Positions of the data are respectively indicated by an O mark and a star mark in FIG. 7B. The number of data indicating that the defective nozzle discharges ink is 2, and the number of data which indicates that the defective nozzle discharges ink and is set not to be replaced is 2. The correlation for this transfer position is 1 +1 −1 −1, that is, 0.

FIG. 7C is a view illustrating an operation of estimating a correlation at a transfer position where the printer head 720 moves by one dot to the left. Thus, the printer head 720 moves to the left with respect to corresponding lines 750. When the correlation is estimated in the same manner described above, the correlation is 1.

Eventually, the transfer position of the printer head of FIG. 7C, which has the greatest correlation, is chosen as an optimum transfer position. If results following a data replacement are taken into account in FIGS. 7B and 7C, it can be seen that, in FIG. 7B, two defective nozzles are uncompensated due to the irreplaceable data, whereas in FIG. 7C, all defective nozzles are compensated.

In another example, when data not indicating that the defective nozzle discharges ink is counted, the count is changed by +1, whereas when data which indicates that the defective nozzle discharges ink and is set not to be replaced is counted, the count is changed by −1. However, various increment values may be set, other than values of +1 or −1. For example, the former data may be counted with an increment value of +1, and the latter data may be counted with an increment value of −0.5. The setting of the increment value may be variously controlled by considering a percentage of data that is set not to be replaced among entire data and by considering the number of defective nozzles.

Figure 7D:
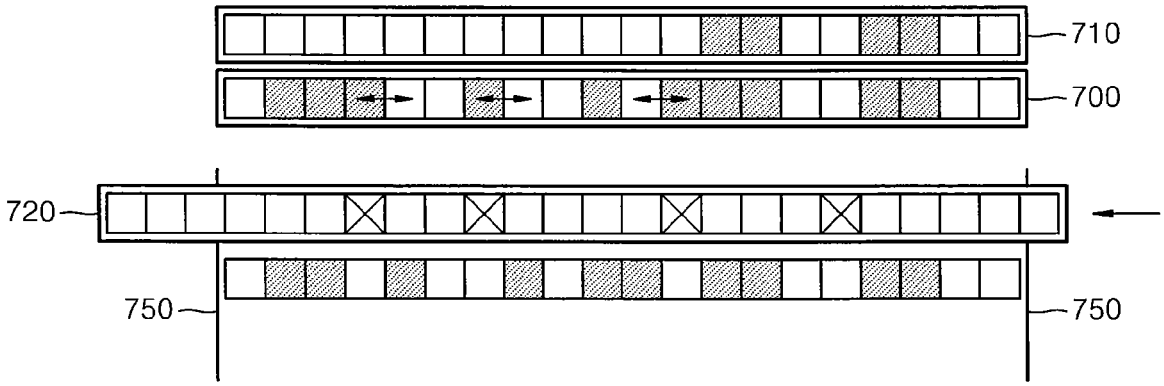
FIG. 7D is a view illustrating a data replacement process at the transfer position of FIG. 7C and a printing result after finishing the data replacement process.

FIG. 7D is a view illustrating a data replacement process at the transfer position of FIG. 7C and a printing result 740 after finishing the data replacement process. Data replacement 760 and the mask data 710 are correlated with respect to the defective inkjet nozzles of the printer head 720. The correlation is estimated by using the aforementioned weight and then the transfer position of FIG. 7C is chosen. As a result, ink is normally discharged for data corresponding to a text portion or a graph portion illustrated in the mask data 710, since the data indicates that a normal nozzle discharges ink. As for the rest of defective nozzles, printing is carried out through a data replacement 760. Eventually, in the example of FIG. 7D, all defective nozzles are compensated for. Therefore, when the movement of the printer head to a transfer position where correspondence is maximized, a plurality of defective nozzles are compensated for.

Figure 8:
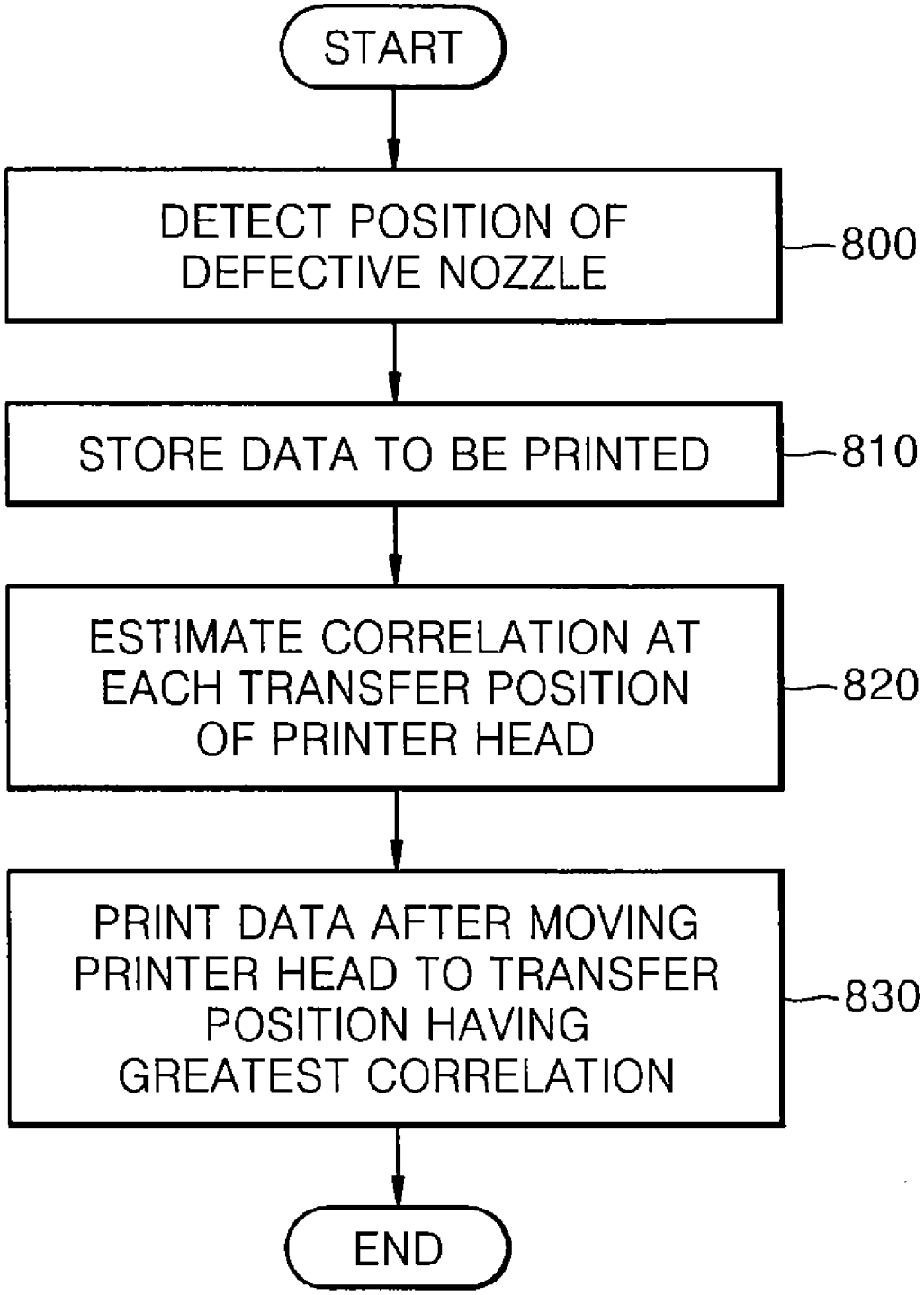
FIG. 8 is a flowchart illustrating a method of compensating for defective nozzles according to an embodiment of the present general inventive concept.

FIG. 8 is a flowchart illustrating a method of compensating for defective nozzles according to an embodiment of the present general inventive concept. The method of FIG. 8 will be described with reference to the apparatus of FIG. 3.

First, the defective nozzle position detection unit 300 detects a position of a defective nozzle among nozzles of a printer head (operation 800). The position of the defective nozzle is recognized as presented above.

Next, the data storage unit 310 stores data to be printed (operation 810). Namely, the data storage unit 310 stores data respectively corresponding to the plurality of nozzles indicating whether the nozzles discharge ink.

While moving the printer head, the correlation estimation unit 320 estimates a correlation of each transfer position (operation 820). As described above, the correlation estimation unit 320 estimates a correlation between the position of the defective nozzle and the stored data indicating that the defective nozzle discharges ink at each position where the printer head moves in a direction perpendicular to the paper transfer direction, and then outputs information of a transfer position having the greatest correlation among the estimated correlations. Specifically, the correlation may be estimated by counting the number of data indicating that the defective nozzle discharges ink with respect to each transfer position.

Data stored in the data storage unit 310 is provided to the print unit 330. The print unit 330 places the printer head at the transfer position having the greatest correlation based on transfer position information provided by the correlation estimation unit 320 and carries out a printing operation (operation 830).

Figure 9:
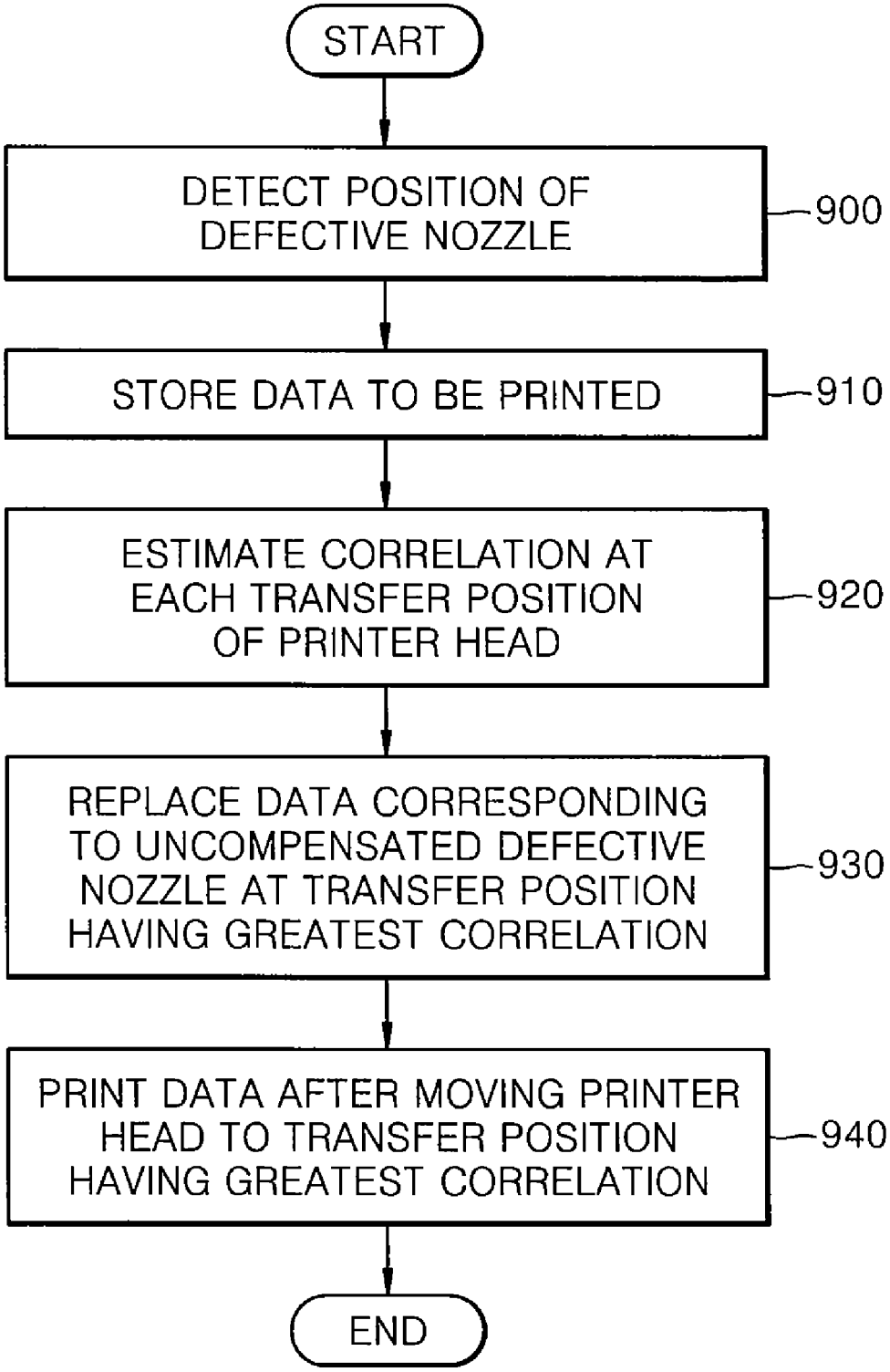
FIG. 9 is a flowchart illustrating a method of compensating for defective nozzles according to another embodiment of the present general inventive concept.

FIG. 9 is a flowchart illustrating a method of compensating for defective nozzles according to another embodiment of the present general inventive concept. The method of FIG. 9 will be described with reference to the apparatus of FIG. 5.

First, the defective nozzle position detection unit 500 detects a position of a defective nozzle among nozzles of a printer head (operation 900). The position of the defective nozzle is recognized in the aforementioned manner.

Next, the data storage unit 510 stores data to be printed (operation 910). Namely, the data storage unit 510 stores data respectively corresponding to the plurality of nozzles indicating whether the nozzles discharge ink. The data includes data that is set not to be replaced with adjacent data. For example, the data that is set not to be replaced may be data for a text portion or a graph portion.

While moving the printer head, the correlation estimation unit 520 estimates a correlation of each transfer position (operation 920). As described above, the correlation estimation unit 520 estimates a correlation between the position of the defective nozzle and the stored data indicating that the defective nozzle discharges ink at each position where the printer head moves in a direction perpendicular to the paper transfer direction, and then outputs information of a transfer position having the greatest correlation among the estimated correlations. However, when the data, which indicates that the defective nozzle discharges ink, is set not to be replaced, the correlation is preferably estimated by using the negative weight.

After operation 920, the data replacement unit 540 replaces the data indicating that the defective nozzle discharges ink with the adjacent data at a transfer position having the greatest correlation (operation 940). Preferably, after data replacement, the replaced adjacent data, which is positioned at the left or right of the data indicating that the defective nozzle discharges ink, does not indicate whether nozzles discharge ink. Meanwhile, the data replacement may not be carried out for the data indicating that the defective nozzle discharges ink among the data that is set not to be replaced.

The print unit 530 places the printer head at the transfer position having the greatest correlation, obtains data from the data replacement unit 540, and carries out a printing operation (operation 940).

Accordingly, in an image forming apparatus having inkjet nozzles (i.e., an inkjet printer) and image quality deterioration due to defective nozzles (i.e., nozzles that cannot discharge ink) may be compensated for by replacing data after moving a printer head to an optimum transfer position.

In addition, image quality deterioration occurring when half-tone data for a text or a graph is replaced can be solved by properly combining a correlation estimation process and a data replacement process.

In addition, the printer head moves to the optimum transfer position only one time according to correlation estimation, and an uncompensated defective nozzle during the one time motion of the printer head can be compensated for through data replacement. Therefore, a slow printing speed occurring when moving the printer head several times per each line to compensate for the defective nozzles can be prevented.

The general inventive concept may also be embodied as computer readable code on a computer readable recording medium. The computer readable recording medium may be any data storage device that may store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). In addition, the computer readable recording medium can also be distributed over network coupled computer systems so that the computer readable code is stored and executed in a distributed fashion. Also, functional programs, code, and code segments for accomplishing the present general inventive concept may be easily construed by programmers skilled in the art to which the present general inventive concept pertains.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An apparatus to compensate for one or more defective nozzles in a printer head having a plurality of nozzles disposed parallel to a direction perpendicular to a paper transfer direction, comprising:

a defective nozzle position detection unit to detect a position of a defective nozzle among the nozzles of the printer head;

a data storage unit to store data respectively corresponding to the plurality of nozzles indicating whether the nozzles discharge ink;

a correlation estimation unit which estimates a correlation between the position of the defective nozzle and data corresponding to the defective nozzle among the stored data at each position to which the printer head moves in a direction perpendicular to the paper transfer direction, and outputs information of a transfer position having the greatest correlation among the estimated correlations; and a print unit to place the printer head at the transfer position having the greatest correlation based on transfer position information provided by the correlation estimation unit and then to perform a print operation.

2. The apparatus of claim 1, wherein the correlation estimation unit estimates the correlation by counting the number of data corresponding to the defective nozzle indicating the defective nozzle does not discharge ink.

3. The apparatus of claim 1, further comprising a data replacement unit to replace data corresponding to the defective nozzle indicating the defective nozzle discharges ink with adjacent data at the transfer position having the greatest correlation.

4. The apparatus of claim 3, wherein the data to be replaced is positioned to the left or right of the data corresponding to the defective nozzle indicating that the defective nozzle discharges and is data indicating a nozzle discharges ink.

5. The apparatus of claim 3, wherein the stored data comprises data that is set not to be replaced with the adjacent data.

6. The apparatus of claim 5, wherein the data that is set not to be replaced is data to be printed that forms a text portion or a graph portion.

7. The apparatus of claim 5, wherein the data that is set not to be replaced is not replaced by the data replacement unit.

8. The apparatus of claim 7, wherein the correlation estimation unit assigns the data that is set not to be replaced a negative weight in the correlation estimation.

9. A method of compensating for one or more defective nozzles in a printer head having a plurality of nozzles which is disposed parallel to a direction perpendicular to a paper transfer direction, comprising:

detecting a position of the one or more defective nozzles among the plurality of nozzles of the printer head;

storing data respectively corresponding to the plurality of nozzles indicating whether the nozzles discharge ink;

estimating a correlation between the position of the one or more defective nozzles and data corresponding to the one or more defective nozzles among the stored data at each position where the printer head moves in a direction perpendicular to the paper transfer direction; and performing printing after placing the printer head at a transfer position having the greatest correlation among the estimated correlations.

10. The method of claim 9, wherein the correlation is estimated by counting the number of data indicating the one or more defective nozzles does not discharge ink among data that corresponds to the defective nozzle.

11. The method of claim 9, further comprising replacing data indicating the one or more defective nozzles discharges ink with adjacent data after the correlation estimation.

12. The method of claim 11, wherein the adjacent data to be replaced is positioned to the left or right of the data indicating the one or more defective nozzles discharges ink and is data indicating a nozzle does not discharge ink.

13. The method of claim 11, wherein the stored data comprises data that is set not to be replaced with the adjacent data.

14. The method of claim 13, wherein the data that is set not to be replaced forms a text portion or a graph portion.

15. The method of claim 13, wherein in the replacing of data, the data replacement is not performed on the data indicating the one or more defective nozzles discharges ink among the data that is set not to be replaced.

16. The method of claim 15, wherein in the correlation estimation data corresponding to the defective nozzle indicating the one or more defective nozzles discharges ink among the data that is set not to be replaced is counted using a negative weight.

* * * * *

UNITED STATES PATENT AND TRADEMARK OFFICE

CERTIFICATE OF CORRECTION

PATENT NO. : 7,641,302 B2
APPLICATION NO. : 11/420120
DATED : January 5, 2010
INVENTOR(S) : Ho-keun Lee It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 539 days.

Signed and Sealed this

Twenty-first Day of December, 2010

David J. Kappos

David J. Kappos
*Director of the United States Patent and Trademark Office*